US005428905A

United States Patent [19]

Beurel et al.

[11] Patent Number: 5,428,905

[45] Date of Patent: Jul. 4, 1995

[54] PROCESS FOR THE REGULATION OF LYOPHILIZATION

[76] Inventors: Guy Beurel, 46, avenue Aristide Briand; Serge Beurel, 49 bis, avenue Aristide Briand; Gilles Beurel, 2, rue de la Gare, all of 95530 La Frette Sur Seine, France

[21] Appl. No.: 75,651

[22] Filed: Jun. 11, 1993

[51] Int. Cl.[6] ..... F26B 5/06

[52] U.S. Cl. ..... 34/289; 34/292; 34/293; 34/92; 34/408

[58] Field of Search ..... 34/5, 15, 92, 5.1, 287, 34/289, 293, 298, 292, 301, 406, 408, 412

[56] References Cited

U.S. PATENT DOCUMENTS 3,466,756 9/1969 Tooby ..... 34/5
3,487,554 1/1970 Tooby ..... 34/5

FOREIGN PATENT DOCUMENTS 387547 5/1965 Switzerland .

OTHER PUBLICATIONS

Gac et al, "Etude du Piegeage de la vapeur d'eau en Lyophilisation" *Bulletin de L'Institute International du Froid,* 1974, pp. 149–157.

*Primary Examiner*—Denise L. Gromada
*Attorney, Agent, or Firm*—Brian J. Laurenzo; Kent A. Herink

[57] ABSTRACT

The invention relates to a process for the regulation of lyophilization in which the evaporative flux—that is to say, the output of evaporated water transferred on the trap (4)—is measured in a continuous manner, and action is carried out at the temperature of the racks (2) in order to reach, as close as possible, a predetermined optimal flux.

3 Claims, 2 Drawing Sheets

PROCESS FOR THE REGULATION OF LYOPHILIZATION

The invention relates to a new process for regulation, applied to lyophilization.

Lyophilization is, in a very general and schematic manner, a process for drying by means of sublimation, at very low temperatures and at very low pressures.

Lyophilizers are apparatuses which comprise a chamber in which the products which are to be treated are placed and, to the side, a set of apparatuses which generate vacuum and cold, as well as pumps for the circulation of heat-carrying fluids. The chamber comprises an element, called a "trap"; this is a surface element which is intended to receive the water coming from the products. It is brought to a very low temperature through the circulation of a refrigerating fluid.

The products are placed on racks which are distributed regularly over the entire volume of the chamber, and every rack is a plate within which tubes proceed, within the interior of which tubes a cooling fluid, which is of such a type that all the racks are at the same temperature, circulates.

The principle of lyophilization consists of establishing and maintaining, within the enclosure which is subjected to a predetermined pressure, a difference in temperatures between the trap and the racks: an exchange of heat is produced between the hot and cold sources, which is expressed by a transfer of the particles of water to the cold source.

When the temperatures are very low, very much below the freezing point (between around −20° C. and −50° C.), and with very low pressures (of only a few Pascals), the frozen water is evaporated without passing through the intermediary liquid state: this is what is called sublimation, and deposits are made on the coldest surface in the form of crystals.

The choice of pressures and temperatures is determined in such a manner that it is always below the point of change of condition of the water: the transfer is carried out through differences in the vapor tensions.

The treatment consists of placing the products on the racks, in order to lower the temperature of the racks, at controlled speed, and in order to freeze them and to then cool the trap, by then producing a vacuum within the chamber. When the difference of temperature between the racks and the trap is sufficient for a given pressure, the sublimation of the water contained within the product begins.

In addition, and in a known manner, it is necessary to maintain a level of leakage of air, which can be controlled, within the chamber.

The curves which are depicted in the Appendix show the development of the temperatures and of the pressure in the chamber as a function of the time, in the case of an example of lyophilization carried out on pharmaceutical products:

The first stage is that of the freezing of the products (a) and the cooling of the trap (d): in order to ensure a good and complete freezing—that is to say, one throughout the entire depth of the product—the racks (b) are cooled to a temperature of around −45° C.; the speed of this cooling is controlled in order to prevent the appearance of tensions on the walls of cells of living organic materials between the water, on the one hand, and the ice, on the other hand, tensions which tear down and destroy the said cells.

The racks are then reheated in order to bring them up to a temperature which is slightly lower than the eutectic point of the product, or generally to around −18° C. (this temperature varies as a function of the nature of the product and may, therefore, be different enough, depending on the case).

When the racks reach their lowest temperatures, the trap is then cooled off. During the heating of the racks, the vacuum pump (c) is brought into operation.

The second stage, that is to say, the sublimation, begins practically from the beginning of the application of the vacuum.

Throughout the entire duration of the sublimation, the temperature of the product is approximately constant. As soon as this is achieved—that is to say, when all the frozen water which is contained in the product has been transferred to the trap—the temperatures of the racks and of the product increase.

In actual practice, the end of the sublimation is measured by means of the development of the temperature of the racks, and controlled by the time: throughout the entire duration of the sublimation, the temperature of the racks is kept constant by means of a supply of energy: the racks are heated to around −20° C. This supply of energy is consumed by the transfer of the water and, when the product is empty of water, this energy increases its temperature.

In point of fact, a small quantity of water, which is called the "bound water" still remains. These are particles of water which remain as if coupled to the solid elements by means of electrical bridges or fields.

This "bound water" is eliminated during the third phase, which is termed "desorption".

While the temperature of the trap is kept around −50° C. the racks are heated up to the temperature of around +30° C., while the vacuum is pushed up to around a few Pascals (around 10−2 millibars). Under this elevation of temperature, combined with the drop of the pressure, the connections of the particles of water are broken, and the bound water is evaporated and transferred to the trap.

One significant difficulty of the desiccation by means of lyophilization is the duration of the treatment, which is several hours. It has been attempted, therefore, to find differences of temperatures—that is to say, differences of vapor tension—between the trap and the product which are optimal for a specific pressure prevailing in the chamber, and a temperature of the trap which is fixed in such a manner as to reduce the time of treatment to the greatest extent possible.

It is very difficult to determine these optimal conditions, because they depend, to a large extent, on the product which is being treated. When pharmaceutical products are involved, their cost is such that it is not possible to carry out studies on samples. At the present time, this disadvantage has been eliminated by carrying out a plotting of statistical measurements which are reproducible. It is, in fact, indispensable to be able to reproduce the same treatment in several successive batches of the same product, in such a manner as to precisely obtain the same final product.

The duration of the treatment can be reduced by accelerating the sublimation through the increase of the differences of temperature between the trap and the racks. However, two major problems are encountered here:

It is easier and less costly to increase the temperature of the racks than it is to reduce that of the trap, which is already very low, but one is limited by the temperature of melting: above this temperature threshold, the water which is sublimated is liquefied, and there is no more transfer into the trap.

The sublimation is more rapid at the beginning of the treatment, because it always begins with the water which is found on the surface, then descends progressively in the depth and the time and distance of passage of the water contained within the lower layers, up to the point that the surface lengthens the length of time of the transfer. The duration of the treatment depends, therefore, on the height of the product which is contained in the recipients and, likewise, on the higher exchange surface.

When the distance that the vapor must traverse through the product becomes important, the sublimation is slowed down, and it is accelerated by increasing the temperature of the racks, with the risk previously noted of being placed beyond the temperature of melting.

Furthermore, when the sublimation is too rapid, a degradation of the product can be produced through the erosion of the material: the particles escape too rapidly and break up the cells which constitute the product. And, the defective product must then be eliminated.

The more expensive the products, the more costly is the loss.

In actual practice, the only solution which has used up to the present time is that of preserving a constant difference of temperature between the racks and the product, up to the end of the sublimation stage (characterized by an increase in the temperature of the product). But this solution does not make it possible to actually control the speed of sublimation, and it does not make it possible to change the nature of the product or simply the form of the recipients, that is to say, the exchange surface.

The invention has the objective of resolving these disadvantages.

The invention has as its objective a process for the regulation of lyophilization, characterized in that, the evaporative flux—that is to say, the output of the evaporated water transferred to the trap—is measured in a continuous manner, and action is carried out on the temperature of the racks in order to bring it as close as possible to a predetermined optimal flux.

The invention is again remarkable for reason of the following characteristics:

The thermal balance of the racks towards the trap is determined in a continuous manner, by measuring the following:

The difference of the temperatures of the heat-carrying fluid between the inlet and the outlet of the racks;

The output of the fluid circulating in the racks;

The output of escape of the air and the temperature of the air entering the enclosure in which the product has been placed;

while converting these data into quantities of energy per unit of time, and taking into account the thermal supply of the heat-carrying fluid circulation pumps, whereby this energy balance is converted into weight of water, which gives the quantity of water transferred per unit of time, or the instantaneous rate of sublimation or evaporatory flux.

As a variant, the evaporatory flux is measured, on the basis of the thermal balance calculated in a continuous manner on the trap, by measuring the following:

The difference of temperatures of the heat-carrying fluid between the inlet and the outlet of the trap;

The output of the fluid circulating in the trap;

by converting these data into quantities of energy per unit of time, and by inferring from this the thermal supply of the circulation pumps for the heat-carrying fluid of the trap, the value in water of the lyophilizer and the value in water of the air entering into the chamber through the escape aperture.

In accordance with the invention, again, the values of the thermal fluxes of the racks, on the one hand, are compared with those of the trap, on the other hand, in order to refine the measurements.

As can be seen, this process makes it possible to recognize, at any time, the actual output of the water received on the trap and so, therefore, the rapidity of the sublimation.

This process supplies numerous and very important advantages:

It makes it possible to indicate to what extent it is possible to increase the temperature of the racks in relation to the theoretical maximum rate of sublimation, which is given by the temperature of the threshold of melting;

It makes it possible to determine the optimal output, for a predetermined product, beyond which degradations due to erosion appear;

It makes it possible to master the functioning parameters and, therefore, to ensure the reproducibility of the treatment cycles;

It is applicable to all lyophilizers, whatever their size, at the constants near the apparatuses (value in water of the apparatus, output of the air), and in reporting the rate of sublimation per unit of surface;

Furthermore, it makes it possible to recognize, with a greater precision, the beginning and the end of the stage of sublimation.

The invention will be better understood with the aid of the following example of implementation accompanied by a diagram of a plant depicted in the diagram, in which.

Figure 1:
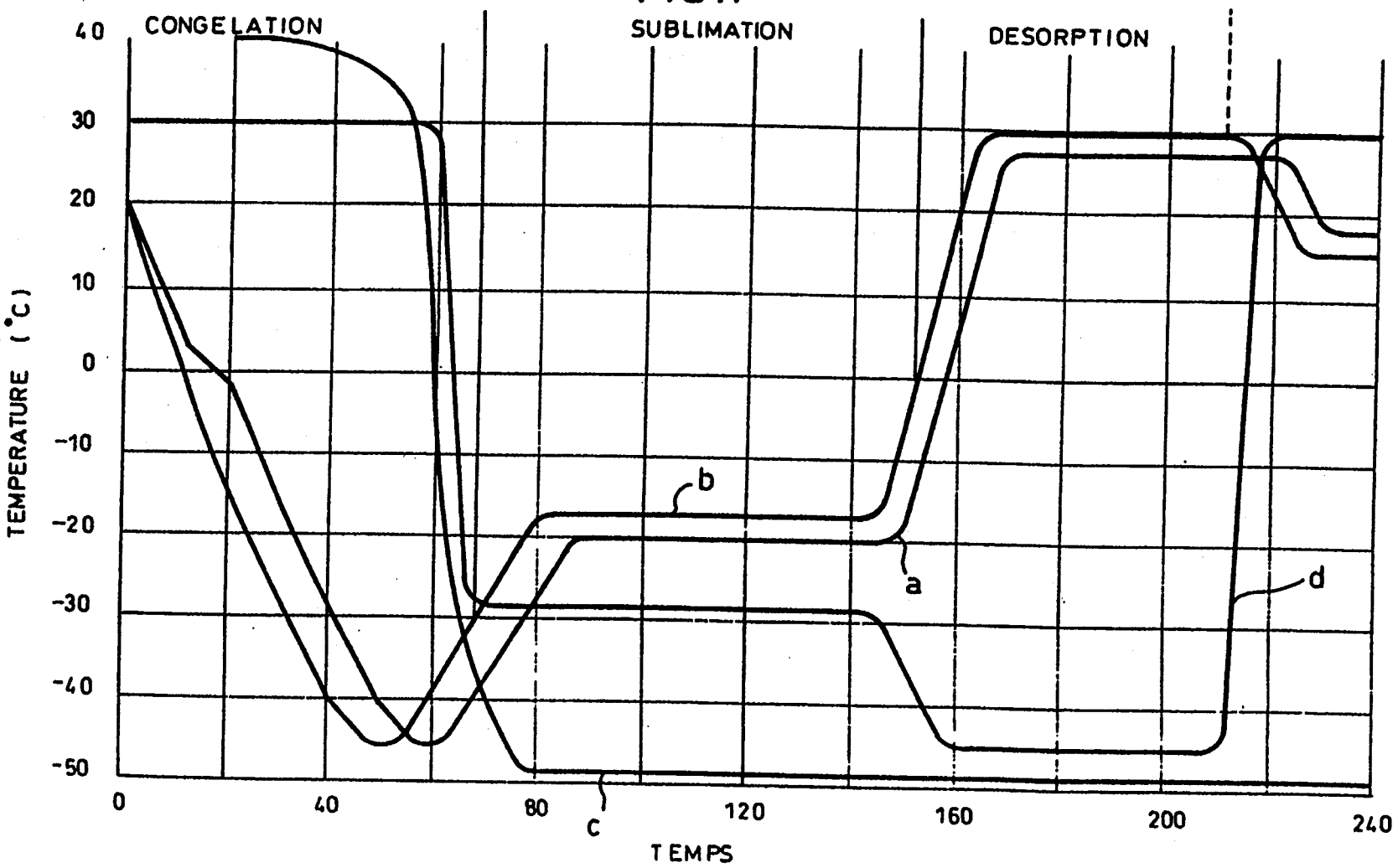
FIG. 1 depicts the functioning curves.
Figure 2:
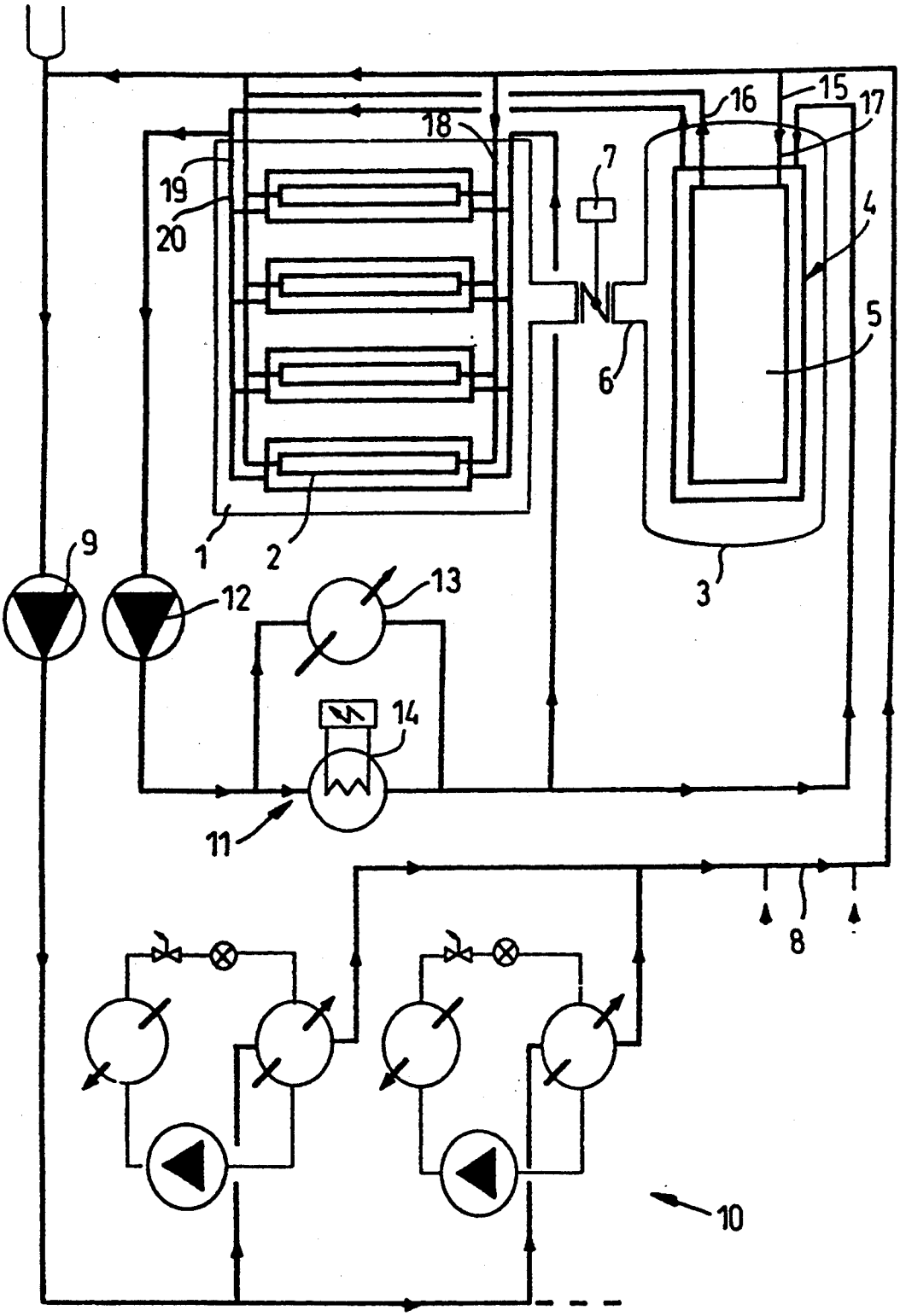
FIG. 2 is the diagram in accordance with the invention.

In this diagram, the plant comprises the following:

A first enclosure (1) in which the products have been placed. This enclosure comprises a plurality of metallic racks (2) traversed by tubes for the circulation of the heat-carrying fluids;

The first enclosure (1) is connected with a second one (3) in which the trap (4) is located. This is essentially composed of at least one surface element (5) of a large size, which is metallic, and which is also traversed by tubes for the circulation of heat-carrying fluids. The connection between the two enclosures is provided by means of a tube (6), the aperture of which is controlled by means of a valve (7).

Two heat-carrying fluid circulation circuits are provided:

A first cold production circuit (8) which feeds, in parallel and independently, the trap (4) and the racks (2); this comprises a circulation pump (9) and one or several units (10) (two, in the diagram) for the production of cold, which are positioned in parallel and which make it possible to adapt the production of cold to the requirement and, above all, to intervene immediately in the event of the breakdown of a unit; this circuit makes it possible to obtain temperatures ranging from −50° C. to −70° C.

A second circuit (11) for the production of cold and of heat which supplies the racks and the trap, likewise in parallel and independently. This comprises a circulation pump (12) and a heat exchanger (13) for the production of cold, as well as a reheating unit (14); this circuit makes it possible to obtain temperatures ranging from −30° C. to +40° C.

The device comprises, in addition, a vacuum pump, which is not depicted in the diagram.

The plant operates in the following manner:

I—Freezing

The products are first placed on the racks at a temperature of approximately 20° C. The rapid freezing is carried out with the primary circuit.

At the end of the freezing, the supply of primary fluid to the racks is cut off, and these are supplied with the secondary fluid; the trap is supplied with primary fluid, the vacuum is applied and the connection between the enclosures is opened.

II—Sublimation

The temperatures of the inlet (15) and the outlet (16) of the trap, and the output (17) of the fluid which passes through it, are continuously measured, on the one hand, as are, on the other hand, the temperatures of the inlet (18) and of the outlet (19) of the secondary fluid passing through the racks, as well as the outlet (20) of the same.

These data, which are continuously fed into a computer, give the evaporatory flux and allow the operator to act on the temperatures through comparison with a predetermined optimal flux.

III—Desorption

At the end of the sublimation, the functioning of the secondary circuit is reversed, which rapidly reheats the racks and brings them to the temperature of around 30° C.

We claim:

1. A process for the regulation of lyophilization, in a chamber having a first enclosure containing a plurality of racks traversed by a first set of tubes for the circulation of a first heat-carrying fluid, said plurality of racks supporting a product to be lyophilized, and a second enclosure containing a trap for evaporated water released from said product, said trap being traversed by a second set of tubes for the circulation of a second heat-carrying fluid, said first and said second enclosures of said chamber being connected to one another by means of a conduit, said chamber being subject to a vacuum with an air leakage flow from said first enclosure to said second enclosure, said first heat-carrying fluid circulating through said first set of tubes being capable of varying the temperature of said plurality of racks sufficiently to control the release of water evaporated from said product and transferred to said trap via evaporative flux, said process comprising:

(a) defining a predetermined optimal flux of water from said product to said trap;

(b) measuring in a continuous manner actual evaporative flux of water from said product to said trap:

(c) comparing said actual evaporative flux of water with said predetermined optimal flux of water; and (d) varying the temperature of said racks with said first heat-carrying fluid in a manner which maintains said actual evaporative flux of water at said predetermined optimal flux of water by transferring heat through said plurality of racks and into said product.

2. The process of claim 1, wherein said step of measuring in a continuous manner said actual evaporative flux of water from said product to said trap comprises:

(a) measuring a temperature differential of said first heat-carrying fluid between an inlet where said first heat-carrying fluid enters said plurality of racks through said first set of tubes and an outlet where said first heat carrying fluid exits said racks from said first set of tubes:

(b) measuring a rate of flow of said first heat-carrying fluid through said racks;

(c) measuring a rate of said air leakage flow through said chamber;

(d) measuring a temperature of air entering said chamber via said air leakage flow;

(e) calculating a rate of supply of thermal energy to said product based upon thermal energy being supplied to said product via said first heat-carrying fluid and said air of said air leakage flow; and (f) calculating a quantity of water released out of said product and to said trap based upon said thermal energy supplied to said product.

3. The process of claim 1 in which said step of measuring in a continuous manner actual evaporative flux of water from said products to said trap comprises:

(a) measuring a temperature differential of said second heat-carrying fluid between an inlet where said second heat-carrying fluid enters said trap enters through said second set of tubes and an outlet where said second heat-carrying fluid exits said trap;

(b) measuring a flow rate of said second heat-carrying fluid through said trap;

(c) measuring a rate of said air leakage flow through said chamber;

(d) measuring a temperature of air entering said chamber via said air leakage flow;

(e) calculating a rate of supply of thermal energy to said product based upon thermal energy being supplied to said chamber via said air of said air leakage flow and via said second heat-carrying fluid; and (f) calculating a quantity of water released out of said product and to said trap based upon said thermal energy supplied to said chamber.

* * * * *